US007331840B2

(12) United States Patent
Amico, Jr.

(10) Patent No.: US 7,331,840 B2
(45) Date of Patent: Feb. 19, 2008

(54) CLOSURE SYSTEM FOR A STUFFED TOY

(76) Inventor: John Amico, Jr., 25748 S. Kensington, Monee, IL (US) 60449

( * ) Notice: Subject to any disclaimer, the term of this patent is extended or adjusted under 35 U.S.C. 154(b) by 0 days.

(21) Appl. No.: 11/225,446

(22) Filed: Sep. 13, 2005

(65) Prior Publication Data

US 2007/0060016 A1 Mar. 15, 2007

(51) Int. Cl.
*A63H 3/02* (2006.01)

(52) U.S. Cl. ..... 446/369

(58) Field of Classification Search ..... 446/369, 446/370, 371, 372; 383/36, 93, 95, 904
See application file for complete search history.

(56) References Cited

U.S. PATENT DOCUMENTS

| | | | | | |
|---|---|---|---|---|---|
| 665,942 | A | * | 1/1901 | Tabler | 383/74 |
| 1,307,218 | A | | 6/1919 | Spencer | |
| 1,485,638 | A | | 3/1924 | Smith | |
| 1,658,294 | A | * | 2/1928 | Lewis | 150/150 |
| 2,347,405 | A | * | 4/1944 | Ford | 446/369 |
| 3,419,993 | A | | 1/1969 | Rodgers | |
| 4,694,829 | A | | 9/1987 | Frye | |
| 4,822,285 | A | | 4/1989 | Summerville | |
| 4,878,871 | A | | 11/1989 | Noto | |
| 5,108,195 | A | * | 4/1992 | Perron | 383/10 |
| 5,356,295 | A | | 10/1994 | Grosz | |
| 5,489,231 | A | * | 2/1996 | Leyser | 446/302 |
| 5,855,498 | A | | 1/1999 | Spector | |
| 6,048,248 | A | | 4/2000 | Ritchey | |
| 6,109,196 | A | | 8/2000 | Silber | |
| 6,527,444 | B1 | * | 3/2003 | Buchman | 383/36 |
| 6,547,633 | B2 | | 4/2003 | Haug | |
| 6,685,532 | B1 | | 2/2004 | McLean | |
| 6,755,712 | B2 | | 6/2004 | Morris | |
| 2003/0077978 | A1 | | 4/2003 | Beige | |

* cited by examiner

*Primary Examiner*—John A. Ricci
(74) *Attorney, Agent, or Firm*—McDermott Will & Emery LLP

(57) ABSTRACT

The present invention relates to a toy having a redundant closure system and method for stuffing the same. The toy comprises a body that defines a cavity for receiving filling material. The toy also includes a fill opening in the body, and a closure system. The closure system includes an internal closure assembly and an external closure assembly. The internal closure assembly is attached to an inner surface of the cavity and is provided for securing the filling material within the cavity. The external closure assembly is disposed proximate the fill opening and is provided to encapsulate the internal closure assembly and filling material within the cavity of the toy.

15 Claims, 3 Drawing Sheets

CLOSURE SYSTEM FOR A STUFFED TOY

CROSS-REFERENCE TO RELATED APPLICATIONS

None.

TECHNICAL FIELD

The present invention relates to a stuffed toy, and more particularly, to a stuffed toy having a redundant closure system and method for stuffing the same.

BACKGROUND OF THE INVENTION

It is known to stuff toys with filling material such as synthetic material and other objects. After a toy is stuffed with filling material, it is necessary to close the opening into which the filling material has been deposited. Often times, the opening is closed using stitching, a zipper, buttons, snaps or drawstrings. While such closure mechanisms for securing filling material in a toy have enjoyed a degree of success, these closure mechanism present some drawbacks. For example, these prior closure mechanisms often become damaged or fail during normal use of the toys with which they are used. Thus, the filling material may become exposed. Another drawback arises in circumstances in which it is desirable for a user to stuff a toy at the site of purchase. In such instances, it is often still desirable to provide a secure closure mechanism. Some of the aforementioned closure mechanisms (e.g., stitching) preclude on-site stuffing, while other of the prior closure mechanisms (e.g., buttons, snaps and zippers) fail to the provide more permanent closures necessary to address the concerns described above.

U.S. Pat. No. 6,685,532 to McLean is directed to a plush assembly and method for stuffing the same. According to McLean, the toy includes an aperture for receiving filler material therein. The aperture is opened and closed or sealed with a zipper. The zipper includes a slide that is movable therealong. The slide includes a lock extendable out from the slide that engages the zipper to lock the slide in a position along the zipper. A string is used to prevent the slide from being locked until the plush is filled and the aperture is closed. Then the string is removed by cutting it, maintaining the slide in a locked state. While McLean discloses the use of a zipper as a means to secure the filling material within the plush toy, McLean fails to address the concerns identified above.

U.S. Pat. No. 6,109,196 to Silber presents similar deficiencies. Silber is directed to a method of closing a toy after stuffing. According to Silber, a fill opening is closed by stitching and tensioning a filament. Once the stuffing is complete, the filament must be tied off so that the end of the filament is flush with the exterior surface of the toy.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

The present invention provides a toy having a redundant closure system. The toy comprises a body that defines a cavity for receiving filling material. The toy also includes a fill opening in the body, and a closure system. The closure system includes an internal closure assembly and an external closure assembly. The internal closure assembly is attached to an inner surface of the cavity and is provided to secure the filling material within the cavity. The external closure assembly is disposed proximate the fill opening and is provided to encapsulate the internal closure assembly and filling material within the cavity of the toy.

According to one aspect of the invention, the internal closure assembly comprises at least one locking snap and at least one corresponding snap receiver. Each snap receiver is adapted to cooperatively engage a corresponding locking snap.

According to another aspect of the present invention, the toy comprises a body defining a cavity for receiving filling material, and a fill opening in the body for accessing the cavity. The toy also includes a sleeve having a first end and a second end. The first end of the sleeve is securably attached to an inner surface of the cavity proximate a perimeter of the fill opening. An internal closure assembly is disposed proximate the second end of the sleeve. The toy also includes an external closure assembly disposed proximate the fill opening. The external closure assembly is disposed proximate the fill opening and is provided to encapsulate the sleeve, the internal closure assembly and filling material within the cavity of the toy.

According to yet another aspect of the present invention, a method for stuffing a toy having the above described redundant closure systems is provided. According to the method, the cavity is first filled with filling material through the sleeve. The internal closure assembly disposed proximate one end of the sleeve is securably fastened, and subsequently inserted into the cavity. The external closure is then operatively closed to encapsulate the sleeve, the internal closure assembly and the filling material within the cavity of the toy.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
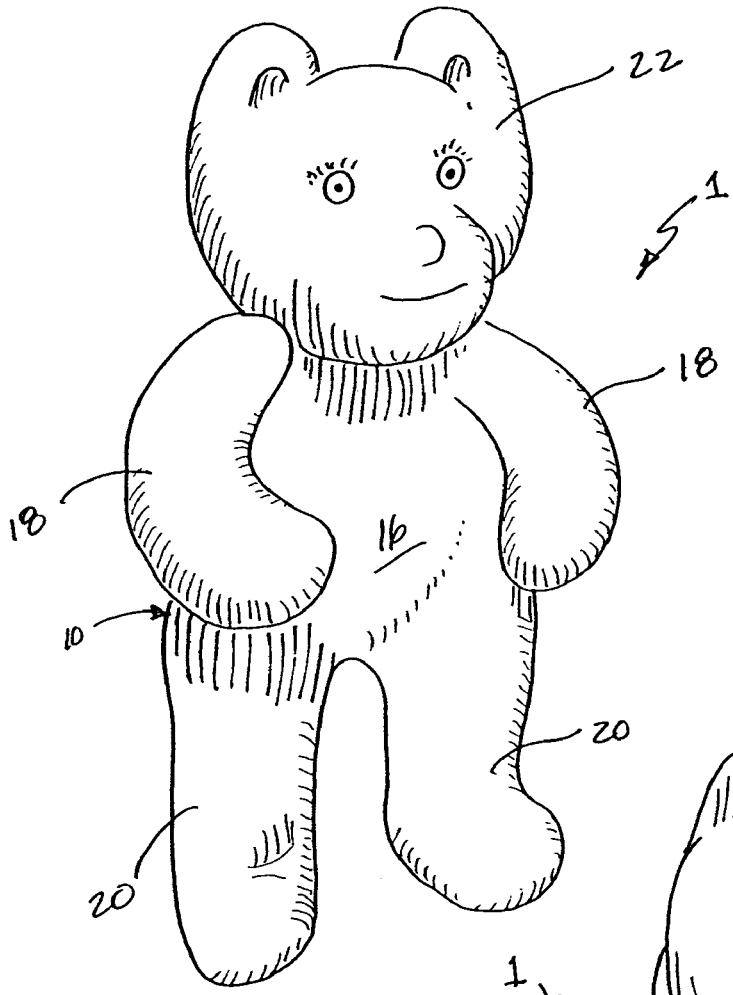
FIG. 1 is a perspective view of a toy according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention generally relates to a stuffed toy having a redundant closure system and a method for stuffing such a toy. Referring now to FIGS. 1-9, the toy 1 generally comprises a body 10, a fill opening 12 in the body 10, and a closure system 14. In one embodiment of the toy 1 shown in FIGS. 1-9, the body 10 of the toy 1 is configured as a "Teddy Bear." The body 10 includes a torso 16, arms 18, legs 20 and a head 22. While the toy 1 shown in FIGS. 1-9 is in the configuration of a bear, it will be recognized by those of skill in the art that the toy 1 may be configured to resemble other animals and toys. Such examples include, but are not limited to, alternative animal configurations, athletic balls and equipment, and dolls. The fabric used in constructing the toy 1 may be a plush material, such as fleece, velour, boa fabric, tricot fiber, polyester fiber, or any other suitable material for constructing a toy 1.

Figure 2:
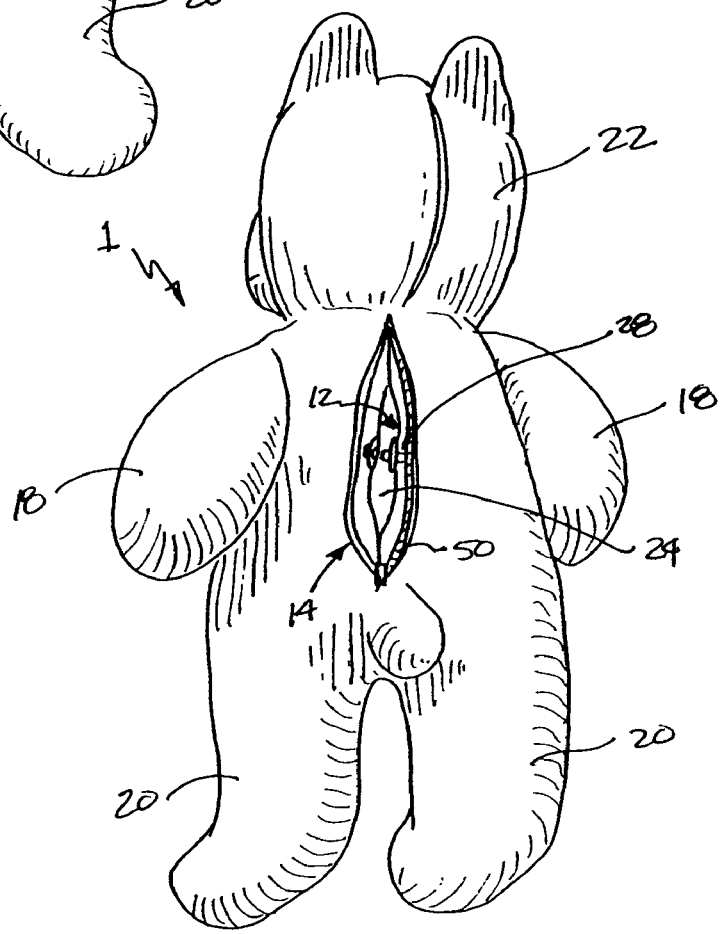
FIG. 2 is a rear perspective view of the toy shown in FIG. 1.

As shown in FIG. 2, the internal portion of the body 10 defines a cavity 24 for receiving filling material 26 as described in further detail below. The body 10 also includes a fill opening 12 for accessing the cavity 24 for stuffing. In particular, the fill opening 12 provides access for hand stuffing or other suitable tools used to deposit filling material 26 into stuffed toys. In FIG. 2, the fill opening 12 is shown along the back panel of the body 10. However, it will be understood and appreciated that the fill opening 12 may be formed in any part of the body 10 of the toy 1. The fill opening 12 is preferably disposed along a seam in the fabric of the body 10. Thus, the fill opening 12 is generally unobtrusive and preserves both the aesthetic and structural integrity of the fabric from which the toy 1 is constructed.

Figure 3:
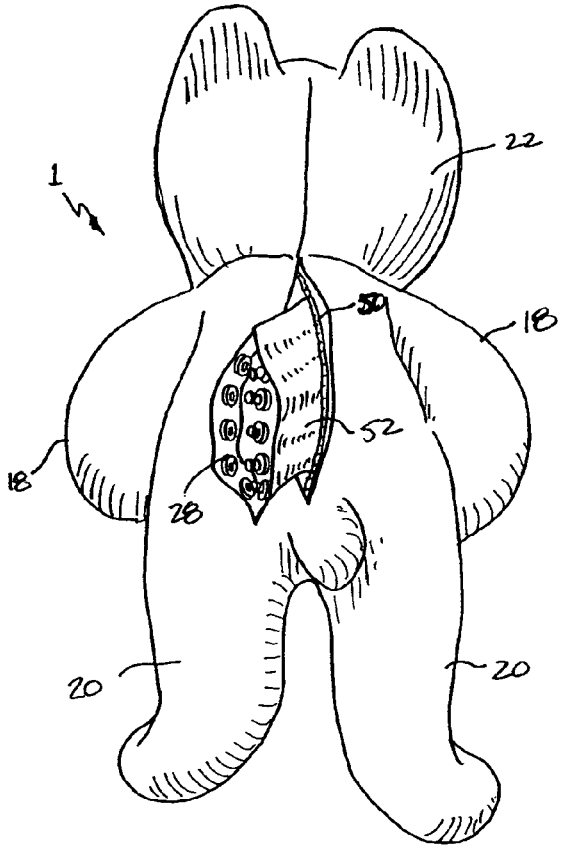
FIG. 3 is a rear perspective view of another embodiment of the toy shown in FIG. 1.

As shown in FIGS. 2 and 3, the toy 1 also includes a closure system 14, and more particularly a redundant closure system. The closure system 14 is comprised of an internal closure assembly 28 and an external closure assembly 50. According to the present invention, the internal closure assembly 28 is preferably a semi-permanent closure system 14 that is provided to secure the filling material 26 within the cavity 24. In other words, the internal closure assembly 28 is meant to prevent access to the filling material 26 once the filling material 26 is secured within the cavity 24.

Figure 4:
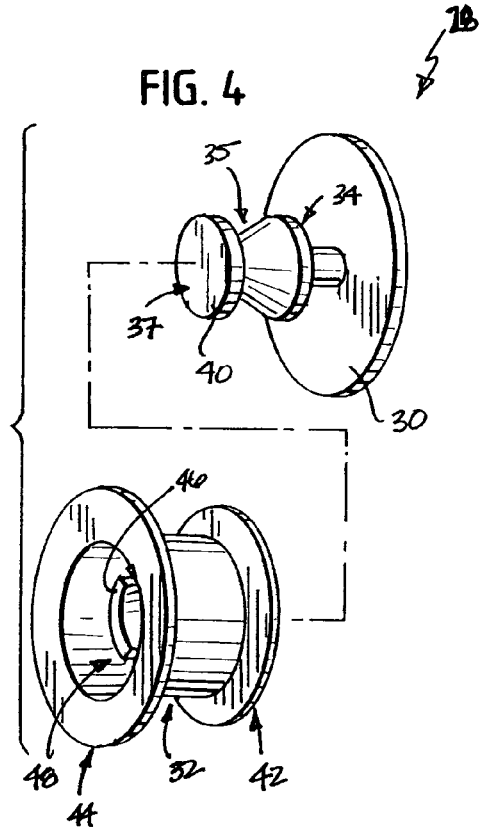
FIG. 4 is an exploded view of an internal closure assembly according to the present invention.
Figure 6:
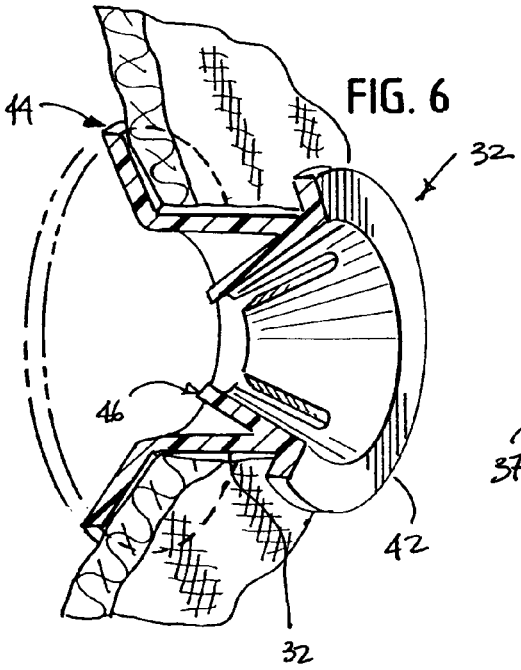
FIG. 6 is a perspective view of a snap receiver used in connection with the internal closure assembly shown in FIG. 4.
Figure 5:
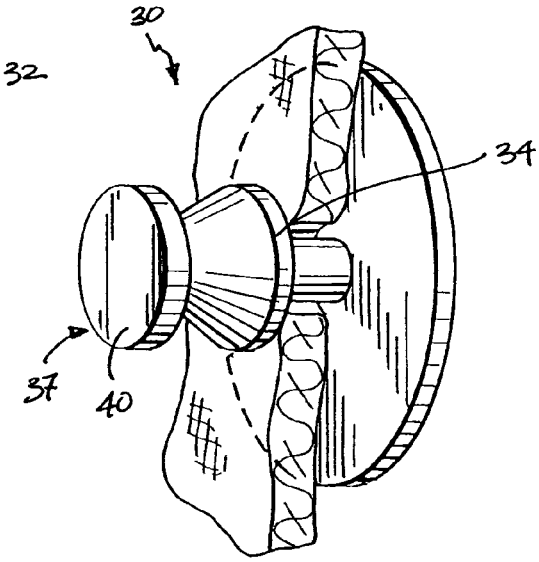
FIG. 5 is a perspective view of a locking snap used in connection with the internal closure assembly shown in FIG. 4.
Figure 7:
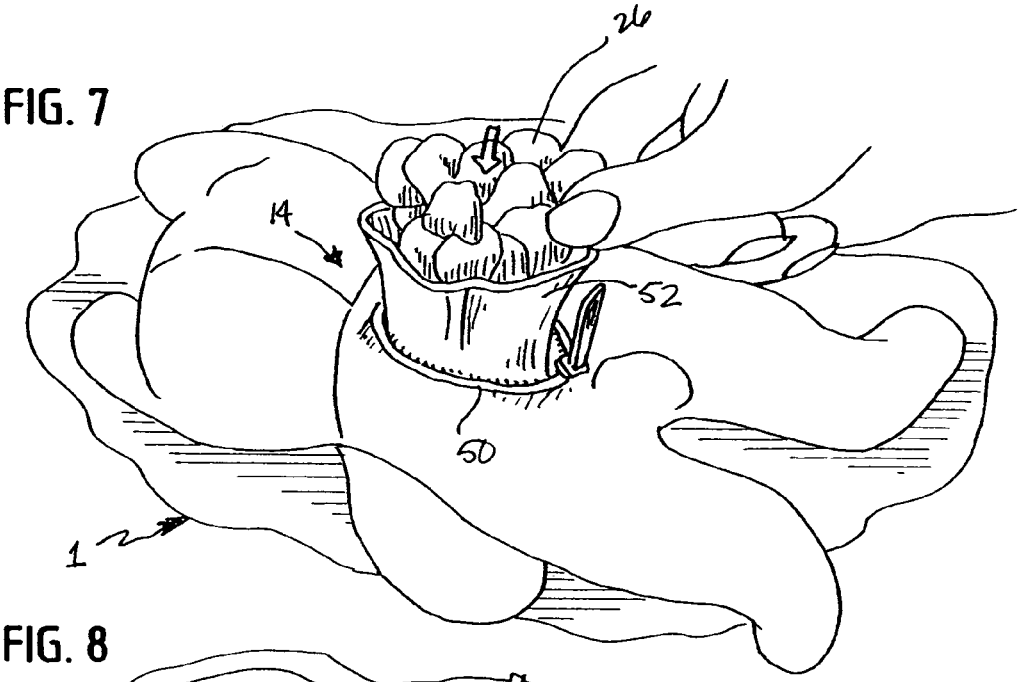
FIG. 7 is a rear perspective view of the toy shown in FIG. 3 being stuffed according to the present invention.
Figure 8:
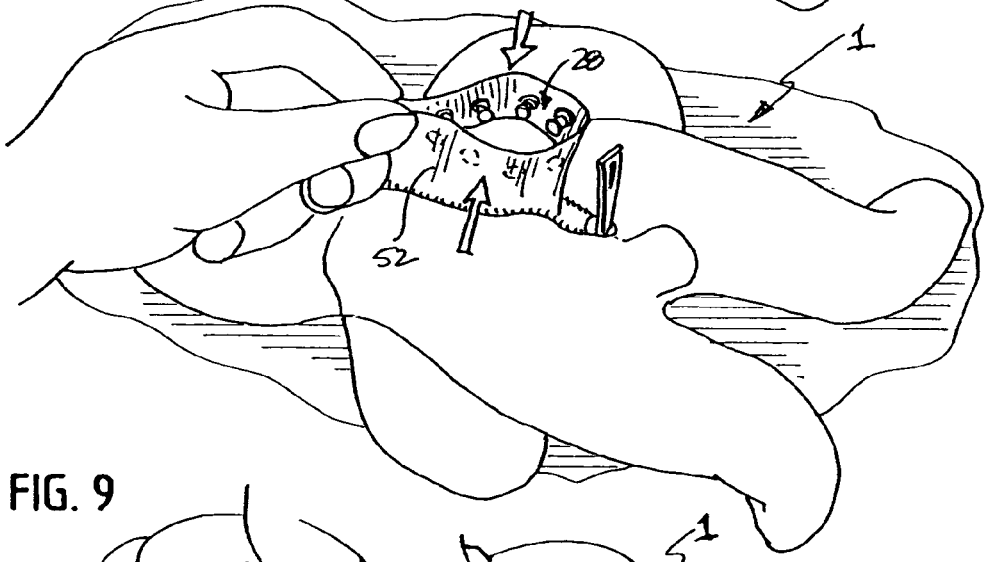
FIG. 8 is a rear perspective view of an operator closing the internal closure assembly of the toy shown in FIG. 3 according to the present invention; and, FIG. 9 is a rear perspective view of an operator closing the external closure assembly of the toy shown in FIG. 3 according to the present invention.
Figure 9:
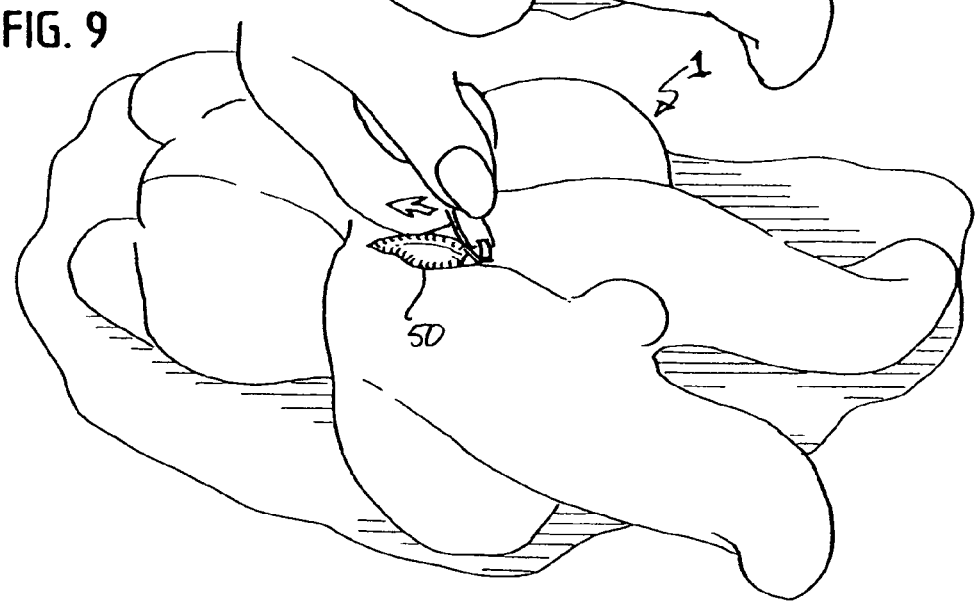

In one embodiment of the present invention shown in FIGS. 4-6, the internal closure assembly 28 comprises at least one locking snap 30 and at least one corresponding snap receiver 32. Each locking snap 30 is adapted to cooperatively engage a corresponding snap receiver 32. According to one preferred embodiment shown in FIG. 5, each locking snap 30 is an elongate body 35 having a first end 34, a second distal end 37 and a locking head 40 disposed at the second distal end 37. The elongate body is a tapered frustoconical body in which the first end 34 has a first diameter and the second end 37 has a second diameter that is smaller than the first diameter. In other words, the smaller diameter is positioned closes to the locking head 40 of the locking snap 30.

Referring to FIG. 6, each snap receiver 32 has a generally cylindrical shape. Each snap receiver 32 has a first end 42 and a second end 44. According to one embodiment, the second end 44 includes an aperture 48 and a shoulder 46 appending inwardly from the perimeter of the aperture 48. The shoulder 46 may be perforated such that an outward force applied to the shoulder 46 causes a slight outward expansion of the aperture 48. Alternatively, at least a portion of the snap receiver 32 proximate the shoulder 46 can be formed from a flexible material, allowing the aperture 48 to expand outwardly as force is applied thereto. While a single locking snap 30 and snap receiver 32 may be employed, it is preferable that a plurality locking snaps 30 and corresponding snap receivers 32 be used to ensure a secured encapsulation of filling material 26 within the cavity 24. It is also contemplated that the locking snaps 30 and the snap receivers 32 be sewn into respective closure strips that may be easily sewn into the fabric proximate the fill opening 12.

In operation, each locking snap 30 is cooperatively inserted into the cylindrical body 10 of a corresponding snap receiver 32. The locking head 40 of each locking snap 30 causes the aperture 48 to slightly expand as the locking head 40 passes through the cylindrical body of the snap receiver 32 and through aperture 48. Accordingly, when the internal closure assembly 28 is in a secured position, a bottom surface of the locking head 40 of each locking snap 30 abuts a top surface of the shoulder 46 and prevents the locking snap 30 from being withdrawn from the snap receiver 32. The locking snaps 30 and snap receivers 32 are preferably made from a semi-rigid polymer material. However, it is contemplated that the locking snaps 30 and snap receivers 32 be formed from any material suitable to provide a secured closure when operatively engaged.

The external closure assembly 50 is provided to encapsulate the internal closure assembly 28 and the filling material 26 within the cavity 24 of the body 10. Accordingly, the external closure assembly 50 is disposed proximate the fill opening 12. The external closure assembly 50 is preferably a zipper. However, it is contemplated that the external closure assembly 50 can be a loop and hook fastener, snaps, buttons, or any other suitable closure mechanism that allows opening and closing of the cavity 24. In some instances, it may be desirable to achieve a more permanent external closure. In such instances, it is contemplated that the locking snap 30 and snap receiver 32 type internal closure assembly 28 described herein be employed in redundancy as the external closure assembly 50.

According to one embodiment of the present invention shown in FIG. 3, the toy 1 also includes a sleeve 52 having a first end 54 and a second end 56. According to this embodiment, the sleeve 52 provides a passageway to assist in funneling filling material 26 into the cavity 24. The sleeve 52 may be formed from any fabric, including cotton, the fabric from which the body 10 of the toy 1 is constructed, or any other suitable material. The first end 54 of the sleeve 52 is securely attached to an inner surface of the cavity 24 proximate the fill opening 12. It is contemplated that the sleeve 52 can be attached to the inner surface of the cavity 24 by stitching, glue, fasteners or other suitable attaching mechanisms.

As shown in FIG. 3, according to the embodiment in which the sleeve 52 is employed, the internal closure assembly 28 is disposed proximate the second end 46 of the sleeve 52. When the toy 1 is filled and fully assembled, the external closure assembly 50 of this embodiment acts to encapsulate the sleeve 52, the internal closure assembly 28 and the filling material 26 within the cavity 24 of the toy 1.

Now will be described a method of stuffing a toy 1 in accordance with the present invention. Generally, the method described herein can be employed with either embodiment of the present toy 1. However, the following description is directed to stuffing a toy 1 having a redundant closure system 14, wherein the toy 1 comprises a body 10 defining a cavity 24 for receiving filling material 26, a fill opening 12 in the body 10 for accessing the cavity 24, a sleeve 52 comprising a first end and a second end, the first end of the sleeve 52 being securely attached to an inner surface of the cavity 24 proximate the fill opening 12, an internal closure assembly 28 disposed proximate the second end of the sleeve 52, and an external closure assembly 50 disposed proximate the fill opening 12.

According to the method, the cavity 24 in the body 10 is first filled with filling material 26 through the sleeve 52. The filling material 26 may be polyester, polyfiber, down or any other suitable material. It may also be desirable to include toy articles, for example, lockets, plastic hearts, keepsakes and the like, as part of the filling material 26.

The internal closure assembly 28 disposed proximate the end of the sleeve 52 is securely fastened. According to one preferred embodiment, the locking snaps 30 of the internal enclosure assembly are inserted into the cylindrical body 10 of a corresponding snap receiver 32. In that way, the locking head 40 of each locking snap 30 causes the shoulder 46 to expand as the locking head 40 passes through the cylindrical body of the snap receiver 32 and through the fill opening 12 in the appending shoulder 46. Accordingly, when the internal closure assembly 28 is in a secured position, the locking head 40 of each locking snap 30 abuts an outer surface of the shoulder 46 and prevents the locking snap 30 from being withdrawn from the snap receiver 32. The fastened sleeve 52 is then inserted into the cavity 24. The external closure is then closed to encapsulate the sleeve 52, the internal closure assembly 28, and the filling material 26 within the cavity 24 of the toy 1.

While the specific embodiments have been illustrated and described, numerous modifications come to mind without significantly departing from the spirit of the invention, and the scope of protection is only limited by the scope of the accompanying Claims.

What is claimed is:

1. A toy adapted to receive filling material, the toy having a redundant closure system and comprising:

a body defining a cavity for receiving filling material;

a fill opening in the body for accessing the cavity; and, a closure system comprising an internal closure assembly and an external closure assembly, the internal closure assembly being attached to an inner surface of the cavity and provided for securing the filling material within the cavity, the external closure assembly disposed proximate the fill opening and being provided to encapsulate the internal closure assembly and the filling material within the cavity of the toy, wherein the internal closure assembly comprises at least one locking snap and at least one corresponding snap receiver, each of the at least one snap receivers being adapted to cooperatively engage a corresponding locking snap, and wherein the locking snap comprises an elongate body having a first end and a second distal end and a locking head disposed at the second distal end.

2. The toy of claim 1, wherein the elongate body is a tapered frustoconical body, the first end having a first diameter and the second end having a second diameter, the second diameter being smaller than the first diameter.

3. The toy of claim 1, wherein when the internal closure assembly is in a secured position the at least one locking snap engages the at least one corresponding snap receiver the locking head is pushed through the aperture in the second end of the snap receiver, and the locking snap is prevented from being withdrawn from the snap receiver by abutment of a bottom surface of the locking head with a top surface of the shoulder.

4. The toy of claim 1, wherein the internal closure assembly the fill opening comprises a plurality of locking snaps and snap receivers.

5. The toy of claim 1, further comprising filling material disposed within the cavity, wherein the filling material is a synthetic material.

6. The toy of claim 1, wherein the external closure assembly is a zipper.

7. The toy of claim 1, wherein the snap receiver is a generally cylindrical body comprising a first end and a second end, the second end including an aperture having a shoulder appending inwardly therefrom.

8. A toy adapted to receive filling material, the toy having a redundant closure system and comprising:

a body defining a cavity for receiving filling material;

a fill opening in the body for accessing the cavity;

a sleeve comprising a first end and a second end, the first end of the sleeve being securably attached to an inner surface of the cavity proximate a perimeter of the fill opening;

a semi-permanent internal closure assembly disposed proximate the second end of the sleeve; and an external closure assembly disposed proximate the fill opening and provided to encapsulate the sleeve, the internal closure assembly and the filling material within the cavity of the toy, wherein the internal closure assembly comprises at least one locking snap and at least one corresponding snap receiver, each of the at least one snap receivers being adapted to cooperatively engage a corresponding locking snap.

9. The toy of claim 8, wherein the locking snap comprises an elongate body having a first end and a second distal end and a locking head disposed at the second distal end.

10. The toy of claim 9, wherein the elongate body is a tapered frustoconical body, the first end having a first diameter and the second end having a second diameter, the second diameter being smaller than the first diameter.

11. The toy of claim 9, wherein when the internal closure assembly is in a secured position the at least one locking snap engages the at least one corresponding snap receiver the locking head is pushed through the aperture in the second end of the snap receiver, and the locking snap is prevented from being withdrawn from the snap receiver by abutment of a bottom surface of the locking head with a top surface of the shoulder.

12. The toy of claim 8, wherein the snap receiver is a generally cylindrical body comprising a first end and a second end, the second end including an aperture having a shoulder appending inwardly therefrom.

13. The toy of claim 8, wherein the internal closure assembly the fill opening comprises a plurality of locking snaps and snap receivers.

14. The toy of claim 8, further comprising filling material disposed within the cavity, wherein the filling material is a synthetic material.

15. The toy of claim 8, wherein the external closure assembly is a zipper.

* * * * *